US005204487A

United States Patent [19]

Turner

[11] Patent Number: 5,204,487

[45] Date of Patent: Apr. 20, 1993

[54] HIGH OUTPUT FILM PIEZOELECTRIC PICKUP FOR STRINGED MUSICAL INSTRUMENTS

[76] Inventor: Robert A. Turner, 209 Bassett St., Petaluma, Calif. 94952

[21] Appl. No.: 762,569

[22] Filed: Sep. 17, 1991

Related U.S. Application Data

[63] Continuation-in-part of Ser. No. 681,116, Apr. 5, 1991.

[51] Int. Cl.[5] ..... G10H 3/18; H04R 17/00

[52] U.S. Cl. ..... 84/731; 84/DIG. 24; 84/730; 84/743

[58] Field of Search ..... 84/DIG. 24, 723, 730, 84/731, 742, 743; 439/77

[56] References Cited

U.S. PATENT DOCUMENTS

| | | | |
|---|---|---|---|
| 3,325,580 | 6/1967 | Barcus et al. . | |
| 3,624,264 | 11/1971 | Lazarus . | |
| 4,314,495 | 2/1982 | Baggs . | |
| 4,491,051 | 1/1985 | Barcus . | |
| 4,727,634 | 3/1988 | Fishman . | |
| 4,774,867 | 10/1988 | Fishman . | |
| 4,944,209 | 7/1990 | Fishman . | |
| 5,029,375 | 7/1991 | Fishman . | |
| 5,042,971 | 8/1991 | Ambrose | 439/77 |

OTHER PUBLICATIONS

Kynar Piezo Film Technical Manual (Pennwalt Corporation, 1987), p. 43.

Kynar Piezo Film News, No. 1 (Pennwalt Corporation, 1987), p. 4.

*Primary Examiner*—William M. Shoop, Jr.
*Assistant Examiner*—Helen Kim
*Attorney, Agent, or Firm*—Ian Hardcastle

[57] ABSTRACT

An electro-mechanical pickup for a musical instrument having a plurality of strings. The pickup includes a core, a first piezoelectric transducer element connected in parallel with a second piezoelectric transducer element, and a two-conductor output lead. Using two piezoelectric transducer elements connected in parallel increases the output voltage and capacitance of the pickup compared with using a single piezoelectric transducer element. The core is elongated, and has a first face opposite a second face. The first piezoelectric transducer element includes first and second electrodes on opposite faces of a first piezoelectric film. The second piezoelectric transducer element includes third and fourth electrodes on opposite faces of a second piezoelectric film. The piezoelectric transducer elements are each responsive to more than one string of the musical instrument. The first piezoelectric transducer element is stacked on the core with the second electrode in contact with the first face of the core. The second piezoelectric tranducer element is stacked on the first piezoelectric transducer element with the third electrode in contact with the first electrode. The output lead is attached to the core, with one conductor electrically contacting the first electrode and the third electrode, and the other conductor electrically contacting the second electrode and the fourth electrode.

29 Claims, 13 Drawing Sheets

HIGH OUTPUT FILM PIEZOELECTRIC PICKUP FOR STRINGED MUSICAL INSTRUMENTS

This application is a continuation-in-part of the inventor's prior application Ser. No. 681,116, filed Apr. 5, 1991.

BACKGROUND OF THE INVENTION

The invention concerns electrical pickups for acoustic guitars. Acoustic guitars, which are the traditional form of guitar, produce a significant output of direct sound energy, largely due to the ability of the body of the guitar to pick up and amplify the vibrations of the strings. As a result of this mechanism, the body contributes considerably to the tonal quality of the sound produced by the guitar. Acoustic guitars produce sufficient direct sound output for them to be usable without amplification when played in small rooms in front of small audiences. To be heard in larger auditoriums, amplification is necessary. For amplification to be used, some means for picking up the sound output of the guitar must also be used.

Electrical pickups for acoustic guitars must be distinguished from electrical pickups for electric guitars because the primary mechanism by which each kind of guitar produces sound is quite different. Electric guitars produce sound by using one or more electric coils to pick up the vibration of the strings (which must be of a magnetic material, normally steel) in a magnetic field. The electrical output of the coils is then amplified and the amplified signal is then reproduced by means of a loudspeaker. Electric guitars produce relatively little direct sound energy themselves, and are heavily reliant on amplification if they are to be heard by more than only the player. Unlike the body of an acoustic guitar, the body of an electric guitar contributes relatively little to the direct sound energy output and to the tonal quality of the sound produced by the loudspeaker.

The conventional approach to picking up the sound on an acoustic guitar is to use a microphone mounted on a stand and directed towards the top of the guitar. A microphone works quite well for solo or small ensemble performances of classical music, but presents at least four problems in performances of more popular music: (1) it restricts the player's ability to move around during the performance; (2) it may pick up too much noise from the action of the player's fingers and hands on the strings and top of the guitar (such noise is called "top noise"); (3) it may pick up its own amplified output, leading to acoustic feedback problems; and (4), when the player shares the stage with loud instruments such as drums, keyboards, and electric guitars and basses, it makes achieving the desired sound balance difficult because it picks up sounds from these other sources in addition to sounds from the acoustic guitar. As a result of these problems, there has for a number of years been a tendency towards using self-contained acoustic guitar pickups which allow the acoustic guitar itself to produce an electrical output signal that is fed by a long cable, or a radio-frequency or infra-red transmitter/-receiver arrangement to suitable amplification and loudspeaker equipment. Such a self-contained pickup arrangement can solve the problems discussed above.

Because it is desirable not to use steel strings on acoustic guitars, and acoustic guitars therefore lack the fundamental mechanical-to-electrical transducer mechanism of the electric guitar, the considerable amount of art relating to electric guitar pickups is not applicable to acoustic guitar pickups.

Basic requirements for a self-contained acoustic guitar pickup can be stated as follows: (1) the pickup must convert the mechanical vibrations of the guitar strings and body into an electrical signal; (2) the pickup must pick up some top noise, but top noise pick up should not be excessive; (3) the pickup should pick up the sound of the guitar without adding colorations of its own; (4) the pickup (together with any amplification required) should have a high electrical signal-to-noise ratio; (5) the pickup should not pick up hum, buzz and other externally induced noise; (6) the pickup should pick up the output of each string more-or-less equally; (7) it should be easy to install the pickup in the guitar, and should require a minimum of modifications to be made to the guitar itself; and (8) it should be easy to remove the pickup and restore the guitar to pickup-less operation.

A number of acoustic guitar pickups are already commercially available. The FRAP pickup, described in U.S. Pat. No. 3,624,264 uses three ceramic or crystalline piezoelectric transducers orthogonally mounted on three of the walls of a small box-shaped enclosure filled with silicone rubber. The pickup is attached to the body of the guitar by means of a wax or other suitable adhesive. The transducers are arranged so that one transducer detects motion along the x axis, another detects motion along the y-axis, and the third detects motion along the z-axis. The outputs of the transducers are fed in parallel into a buffer amplifier. This pickup meets requirements (1) through (3), (6), and (7) stated above. However, its electrical output is low, so it suffers from signal-to-noise ratio problems; and its ability to pick up equally from all of the strings is dependent on where it is mounted on the guitar. It is often mounted under the bridge near the end of the bridge over which the higher pitched strings pass, so tends to pick up predominantly from the higher pitched strings. This disadvantage can be overcome by using two pickups, one mounted near each end of the bridge. This has the further advantage of offering "stereo" operation, but at the expense of doubling the already high cost of the pickup.

Another approach is the combination piezoelectric transducer and saddle of Baggs, described in U.S. Pat. No. 4,314,495. The saddle is the part of the bridge of an acoustic guitar on which the strings rest. Practical embodiments of the Baggs pickup differ somewhat from the configuration described in the patent. Practical embodiments use six series-connected ceramic or crystalline piezoelectric transducers, one for each string, encapsulated in epoxy resin in a U-shaped brass channel transducer housing. The transducer housing is an integral part of a saddle formed using a fibre/resin material such as that sold under the trademark Micarta. The channel construction of the transducer housing together with the suspension of the piezoelectric transducers in epoxy resin, is thought to reduce top noise (Requirement 2 is met).

Installing a Baggs pickup in a guitar requires that the normal saddleslot in the bridge be machined to increase its width to ⅛" (3.2 mm) and its length to 2.875" (73 mm). Thus, requirement (6) is not met. The changes to the saddle slot mean that if the pickup is removed, it must be replaced by a non-standard saddle. Thus, requirement (7) is not met. Moreover, since the pickup includes a completely new saddle, the guitar must be re-intonated when the pickup is installed. Finally, the brass insert in the Baggs pickup makes it more rigid than a normal saddle, which changes the playing action of the guitar. Adjustments to the shape of the saddle are required to restore the action to normal. The pickup is also relatively short lived: the plastic saddle wears considerably more quickly than a conventional bone saddle and, when the saddle wears out, the whole pickup must be replaced. Bone cannot be substituted for plastic because it does not have appropriate directional characteristics (see below). The plastic saddle also tends to break off the brass transducer housing. Each time a saddle wears out or breaks, a new pickup must be installed and the guitar re-intonated.

The Baggs pickup also has some inconvenient electrical properties. The plastic material used in the saddle enables the transducer mounted under each string to pick up vibrations from its own string much more efficiently than vibrations from adjacent strings. The pickup exploits this property to reduce top noise by connecting the transducers under the A and D strings out of phase with the transducers under the other four strings. However, this arrangement causes phasing problems when the electrical output of the guitar is mixed with any signal that might include a component representing the acoustic output of the guitar.

The Fishman pickup is described in U.S. Pat. Nos. 4,727,634, 4,774,867, and 4,944,634. This pickup uses six small (1/16" dia.×0.02," 1.6 mm dia.×0.5 mm) cylindrical ceramic piezoelectric transducers, one for each string. The pickup fits in the bottom of a standard 3/32" (2.4 mm) wide saddle slot, and can be used with the existing saddle if about 1/16" (1.6 mm) is removed from the bottom of the existing saddle. This pickup is easy to install, and does not require that the guitar be re-intonated, but it suffers from the general defects of pickups based on ceramic or crystalline piezoelectric transducers discussed below. Moreover, the pickup is quite complex, since it requires separate components to mount the individual transducers resiliently, to interconnect them, and to screen them from outside interference.

All acoustic guitar pickups based on ceramic or crystalline piezoelectric transducers suffer from a number of common problems: (1) such transducers have mechanical resonances in the audio frequency range that colour the sound of the guitar; (2) the mechanical mountings of such transducers have their own mechanical resonances in the audio frequency range that further colour the sound of the guitar; and (3) such transducers are small and are thus awkward to handle in such assembly operations as attaching wires to them, etc.

A new form of piezoelectric material, a polarized homopolymer of vinylidene fluoride (PVDF), has recently become available. This material is sold under the trademark "KYNAR." Full information about this material can be found in the KYNAR Piezo Film Technical Manual (Pennwalt Corporation, 1987). This piezoelectric material is a plastic film which is available in a number of thicknesses (e.g., 28, 52, 110 microns). PVDF film has a number of properties that make it advantageous for use in acoustic guitar pickups: it has a high output voltage for a given mechanical stress; it has a low mass and a low Q, which means that it responds instantly to a mechanical input, and introduces little coloration of the sound.

Electrical contacts can be made to the surface of the film itself by painting electrodes on the surface of the film with conductive paint, or, preferably for mass-production, silkscreening electrodes on the surface of the film with conductive ink, or vacuum depositing metal electrodes on the surface of the film. Attaching leads to the electrodes presents problems, however, because of the material's low softening point and low resistance to tearing. The manufacturer suggests that a low-temperature solder can be used. This enables a reliable electrical contact to be made, but does not result in a mechanically strong attachment between the electrodes and the output lead.

The use of PVDF film as an acoustic guitar pickup is described at page 43 of the KYNAR Technical Manual. A piece of 28 micron thick film, about 3" by 1" has electrodes on both sides. It is electrically shielded on both sides by means of a metallic foil and mechanically protected by a layer of a flexible plastic laminate. Electrical contacts are made (the manual does not say how) to the electrodes on each side of the film. The complete transducer is attached to the top of the guitar, close to the sound-hole, and oriented with its long axis running in the direction of the strings so that pickup of top noise is reduced. The sound of the pickup is influenced by what is used to attach the pickup to the guitar (double-sided adhesive tape is suggested in the Technical Manual). Moreover, this type of pickup tends to pick up strings that are closer to the pickup more efficiently than strings that are more distant. The pickup placement suggested in the Technical Manual would therefore tend to give a bass-heavy output. This problem could be partially solved by using two pickups, one at each end of the bridge, in a "stereo" arrangement.

A practical embodiment of this pickup solves the lead attachment problem by using sprung mechanical contacts to pick up the electrical output of the transducer. This results in a bulky arrangement, compared with the rest of the pickup, the contact device being a flat rectangular box about 1.2×1.2×0.2 inches (30×30×5 mm).

An alternative form of acoustic guitar pickup using PVDF film is described in Kynar Piezo Film News, No. 1 (Pennwalt Corp., 1987) at page 4. The sides and bottom of standard-sized saddle are partially wrapped with a piece of PVDF transducer film about 2.8×0.7 inches (71×18 mm). The long sides of the transducer film are curved to match the curvature of the top of the saddle. The material is metallized completely on the outside and metallized in six segments, one for each string, on the inside (i.e., the side closer to the saddle). The transducer is glued directly to the saddle. There is no mechanical protection or electrical screening; the player's hand can induce an objectional buzz into the output of the pickup if it gets too close to the pickup. This pickup is also relatively short lived: the saddle material is not as durable as bone, the material normally used for making saddles, and the whole pickup must be replaced and the guitar re-intonated, if the saddle wears out.

This basic assembly would install directly in a standard saddle slot without any modification were it not for the large plastic connector assembly on one end of the modified saddle. To accommodate the connector assembly, the width of the saddle slot in the bridge must be increased to about 0.22" (5.6 mm) for a length of about 0.3" (7.6 mm) and the length of the saddle slot must be increased by about 0.07" (1.8 mm). This pickup is therefore inconvenient to install, and difficult to replace if no longer desired.

Practical embodiments of this pickup are sold as part of the Gibson TM Symbiotic Oriented Receptor System (S.O.R.S.).

In his copending application Ser. No. 681,116, of which application this application is a continuation-in-part, the applicant described a new configuration of acoustic guitar pickup using PVDF or a similar piezoelectric plastic film transducer element that can be installed in an acoustic guitar without the need to modify the standard saddle slot. The prior application described a number of variations on a basic design that consisted of only four component parts: a piezoelectric transducer element, a core, a contact strip, and an output lead, which was preferably coaxial. The core was elongated, had a plurality of faces at least one of which, preferably the largest, was conducting. Preferably, the core had a rectangular cross-section. In the preferred embodiment of the invention described in the prior application, a piece of piezoelectric film considerably larger than the largest face of the core had a first electrode on one side, the electrode having substantially similar dimensions to those of the conductive face of the core, and had a second electrode covering substantially all of the other side. The first electrode was placed in contact with the conducting face of the core and the film was then wrapped 1 and ¼ times around the core and secured in place with a conducting adhesive. The contact strip was secured to part of the second electrode on the film. One conductor of the output lead was secured to the conducting face of the core, the other to the contact strip. The wrapped construction of this pickup enabled the piezoelectric film and its two electrodes to serve as the piezoelectric transducer element of the pickup, as the electrical insulator of the pickup, and as the electrical shield of the pickup.

Although the preferred embodiments of the pickups described in the prior application are compact, simple, and have a satisfactory signal-to-noise ratio, their electrical output level is low compared with competing acoustic guitar pickups. It would be difficult to increase the electrical output of the preferred embodiment of the prior pickups by increasing the thickness of the piezoelectric film because thicker films are difficult to bend in the small radii required. Moreover, the several layers of conducting adhesive used in the prior pickups cushion the piezoelectric transducer element and reduce its electrical output. Although the thickness of the piezoelectric film used in the simpler embodiments of the pickups described in the prior application could be more easily increased, these embodiments had inadequate electrical shielding and insulation.

SUMMARY OF THE INVENTION

The invention is an improved acoustic guitar pickup using PVDF or a similar piezoelectric plastic film transducer element that can be installed in an acoustic guitar without the need to modify the standard saddle slot, and that retains the advantages of simplicity, compactness, and high signal-to-noise ratio of the pickups disclosed in the prior application, while giving a greater electrical signal output level.

Important aspects of the invention include its simplicity, involving only six component parts, a substantial reduction in the use of adhesives (which tend to reduce the output of the piezoelectric transducer element), and novel solutions to the problem of making compact, electrically reliable, and mechanically strong connections from electrodes on a piezoelectric transducer element to an output lead, and hence to an amplifier and loudspeaker. The connections have to be sufficiently compact to enable the pickup to be installed at the bottom of an unmodified standard saddle slot in the bridge of the guitar.

A pickup according to the invention comprises two piezoelectric transducer elements, a core, a contact strip, a separate insulating layer, and an output lead, which is preferably coaxial. The core is elongated, and has a plurality of faces. Preferably, the core has a rectangular cross-section. At least two opposing faces of the core, preferably the largest, are conducting over most of their area. The first face is divided into two conducting areas, a contact area and an output lead connecting area, which is considerably smaller than the contact area. The core gives the pickup its basic mechanical strength, and serves as the primary anchor of the output lead.

The output lead is arranged so that its long axis runs at right angles to the long axis of the core, the core and output lead constituting an L-shaped structure. One conductor of the output lead, preferably the inner conductor, is mechanically attached to the core and makes electrical contact to the output lead connecting area. The strength of the attachment between the output lead and the core is increased by attaching, in addition, the outer conductor of the output lead to a part of the core that is electrically isolated from the part of the core to which the inner conductor is attached. Preferably, the outer conductor of the output lead is attached to the second face of the core. The contact area of the first face of the core is electrically connected to the second face of the core, and hence to outer conductor of the output lead.

A pickup according to the invention has two piezoelectric transducer elements. Each piezoelectric transducer element comprises a small piece of piezoelectric plastic film having substantially similar length and width as the length and width of first face of the core. Each piece of film has two sides. A first electrode is deposited on the first side and a second electrode is deposited on the second side of each piece of film. To increase the electrical output of the pickup, the film is considerably thicker than that used in the pickups described in the prior application. The thicker film generates a greater described in the prior application. The thicker film generates a greater electrical output voltage for a given mechanical stress, but has a lower capacitance. Lower capacitance is disadvantageous because, for a given preamplifier input impedance, it reduces the low-frequency output of the pickup. To overcome this disadvantage, two piezoelectric transducer elements are stacked on top of one another with their first electrodes in contact and their second electrodes interconnected. This arrangement connects the two transducer elements in parallel and recovers most of the capacitance lost as a result of using the thicker film. The electrical output of the stacked piezoelectric transducer elements is responsive to the vibrations of all of the strings resting on the saddle under which the pickup is mounted.

To use the electrical output of the stacked piezoelectric transducer elements, electrical contact must be made to at least one of the first electrodes (which are inside the stack), and to both the second electrodes (which are on the outer faces of the stack). Making the lower piezoelectric transducer element slightly shorter than the upper piezoelectric transducer element exposes one end of the first electrode of the upper piezoelectric transducer element and enables contact to be made to it, and hence to the first electrode of the lower piezoelectric transducer element. The stacked piezoelectric transducer elements are placed on the first face of the core with the second electrode of the lower piezoelectric transducer element in contact with the contact area, and the exposed part of the first electrode of the upper piezoelectric transducer element in contact with the output lead connecting area. Thus, the first electrodes are electrically connected to the inner conductor of the output lead, and the second electrode of the lower piezoelectric transducter element is electrically connected to the outer conductor of the output lead.

A metal or metallized plastic contact strip is attached to, and is in electrical contact with, the second electrode of the upper piezoelectric transducer element. The contact strip wraps over the end of the core at the same end as that to which the output lead is attached, and is mechanically attached to, and is in electrical contact with, the outer conductor of the output lead. This effectively interconnects the second electrodes of the two piezoelectric transducer elements.

The contact strip, the contact area of the first face of the core, the second face of the core, and the second electrodes of the piezoelectric transducer elements provide electrical shielding for the pickup. The effectiveness of this shielding in increased by slightly reducing the dimensions of the first electrodes of both piezoelectric transducer elements to leave a non-metallized strip around the periphery of each first electrode, enabling the shielding better to surround the first electrodes. Also, the increased signal output of the pickup according to the invention compared with the pickups disclosed in the prior application makes the shielding requirements less severe.

To provide electrical insulation, to give the pickup mechanical protection, and to hold together the components of the transducer part of the pickup (i.e., the core, piezoelectric transducer elements and contact strip assembly), the transducer part of the pickup is wrapped with an insulating layer. The insulating layer comprises a shaped piece of paper, plastic or other insulating film wrapped 1 and ¼ times around the transducer part of the pickup.

In the preferred embodiment, a rectangular piece of 1/32" thick double-sided fibre-glass printed circuit board material serves as the core, the two copper-clad sides of the board forming the largest faces. Copper is selectively removed from the faces by etching to provide, on one face, the contact area at one end and the output lead connecting area covering substantially all of the rest of the face, and, on the other face, the anchor pad for the outer conductor of the output lead at the same end as the output lead connecting area. The inner conductor of the output lead is inserted into a plated-through hole in the output lead connecting area and is soldered in place. A second plated-through hole interconnects the contact area on the first face of the core with the second face of the core, and hence with the anchor pad for outer conductor of the output lead.

The pickup is installed in a guitar by de-tensioning the strings, and removing the bridge saddle. A hole, about the same diameter as the width of the saddle slot (3/32" or approximately 2.4 mm), is drilled through the bridge and the top of the guitar at one end of the saddle slot. About 1/16" (1.6 mm) of material is removed from the bottom of the saddle, to reduce its height by the thickness of the transducer part of the pickup. The output lead is threaded through the hole, and the transducer part of the pickup is installed at the bottom of the saddle slot. The saddle is then re-inserted in the saddle slot, the strings are re-tensioned and the guitar re-tuned. Because the existing saddle is used, and the height of the top of the saddle above the body is the same as before the pickup was installed, there is no need to re-intonate the guitar after installing the pickup. Because the transducer is flexible, it adapts to the shape of the saddle and therefore does not change the action of the guitar.

The basic pickup according to the invention can be modified to provide two electrical output signals, one mainly representing the output of some strings of the guitar, the other mainly representing the output of the other strings of the guitar.

The pickups described can also be adapted for use in other types of stringed instruments which translate the vibrations of the strings into variations of pressure.

Further details of the pickup are given in the drawings and the detailed description of the invention which follow.

DESCRIPTION OF THE DRAWINGS

FIG. 3(*b*) is a cross-sectional view of the bridge of the typical acoustic guitar shown in FIG. 3(*a*), showing a pickup according to the invention installed under the saddle in the saddle slot.

FIG.4(*b*) is an exploded view of the transducer part of the preferred embodiment of a pickup according to the invention.

FIG.6(*b*) is a plan view of the second face of the core of the preferred embodiment of a pickup according to the invention, showing details of the anchor pad and the plated-through hole into which the first conductor of the output lead is inserted.

FIG. 8(*a*) is a plan view of the lower piezoelectric transducer element showing how the periphery of the first electrode is inset from the periphery of the piezoelectric film.

FIG. 8(*b*) is a cross sectional view of the lower piezoelectric transducer element shown in FIG. 8(*a*).

FIG. 8(*c*) is a plan view of the upper piezoelectric transducer element showing how the periphery of the first electrode is inset from the periphery of the piezoelectric film.

FIG. 8(*d*) is a cross sectional view of the upper piezoelectric transducer element shown in FIG. 8(*c*).

FIGS.9(*b*) and 9(*c*) show various ways of attaching the contact strip to the outer conductor of the output lead in a pickup according to the invention:

FIG. 9(*b*) shows a crimp receptacle attached to the contact strip, and

FIG. 9(*c*) shows the contact strip soldered to the output lead.

FIG. 11(*b*) shows a plan view of the first face of the core of a two output lead "stereo" version of the pickup according to the invention.

FIG. 11(*c*) shows plan views of the first electrodes of both piezoelectric transducer elements of a two output lead "stereo" version of the pickup according to the invention.

FIG. 11(*d*) shows a plan view of the contact strip of a two output lead "stereo" version of the pickup according to the invention.

FIG. 11(*e*) shows a plan view of the insulating layer of a two output lead "stereo" version of the pickup according to the invention.

DETAILED DESCRIPTION OF THE INVENTION

Figure 1:
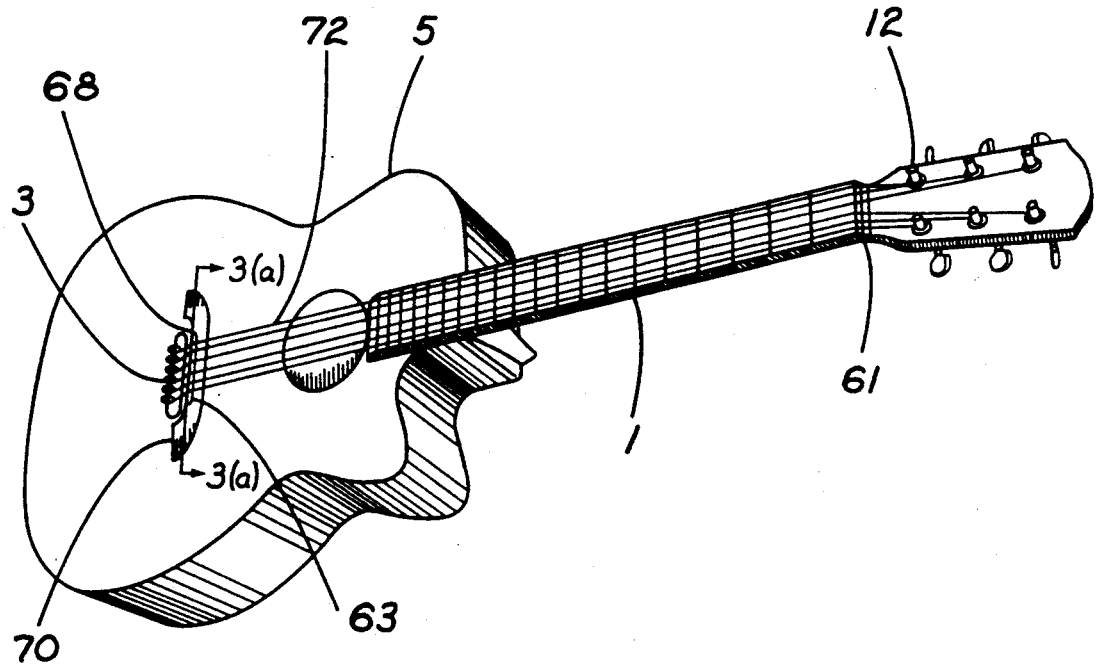
FIG. 1 PRIOR ART
FIG. 1 is a perspective view showing the main parts of a typical acoustic guitar.

The structure of a normal acoustic guitar is shown in FIG. 1. Neck 1 is attached to body 5. Strings 72 are attached to body 5 by means of anchor points 3 at one end and at the other end by tuning mechanism 12. The strings rest on saddle 63, which is mounted in saddle slot 68 in bridge 70. The mechanical vibrations of strings 72 are transmitted by saddle 63 to bridge 70 and hence to body 5, and cause body 5 to vibrate. Vibrating guitar body 5 effectively couples the vibrations of strings 72 to the surrounding air. Saddle 63, together with nut 61, also defines the vibrational length of each string. By adjusting the precise point on the saddle at which each string makes contact with the saddle, the guitar is intonated, so that when each string is stopped at its octave fret, the note produced is at the same pitch as the second harmonic of the open string.

Figure 2:
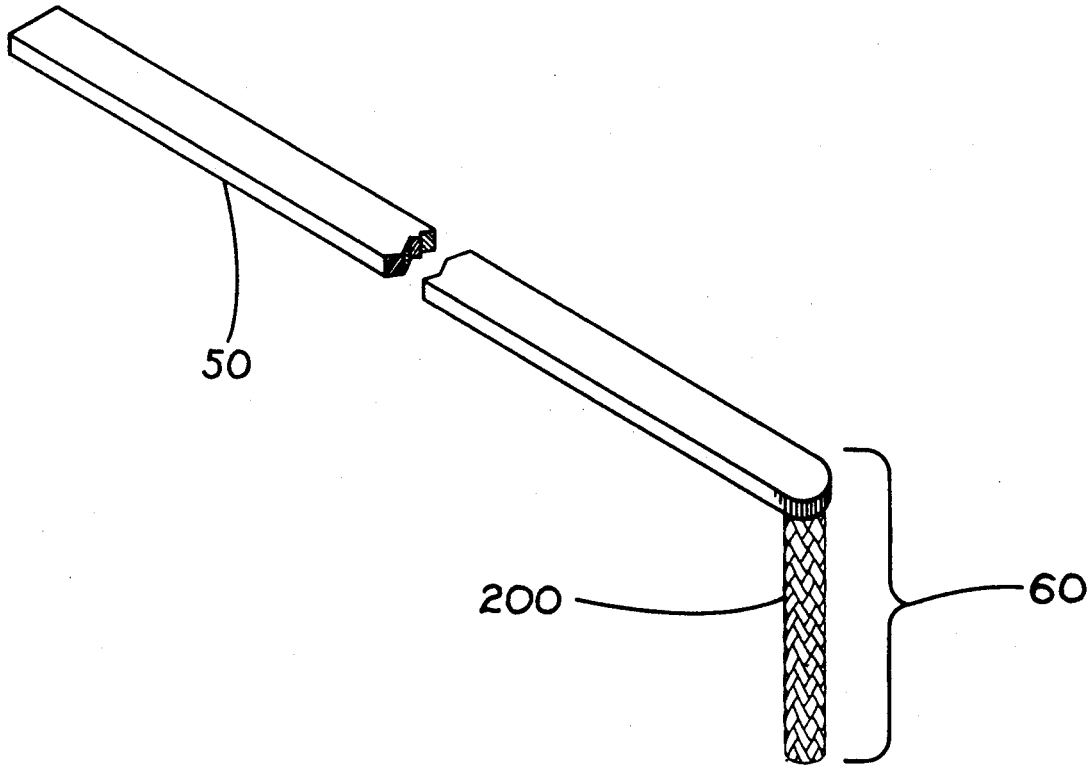
FIG. 2 is a perspective view showing an embodiment of a pickup according to the invention.

FIG. 2 shows pickup 60, comprising transducer 50 and coaxial output lead 200. Because the length of the pickup is over forty times its width, FIG. 2 and most of the other drawings showing the pickup and its components show the pickup and its components in broken form, so that details of the width and thickness of the pickup can be depicted.

Figure 3A:
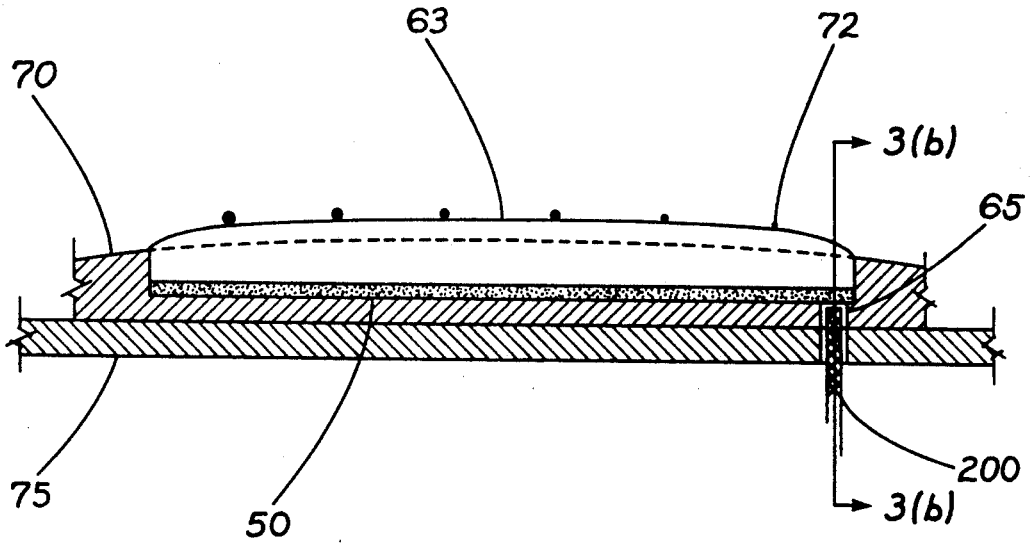
FIG. 3(*a*) is a cross-sectional view of the bridge of the typical acoustic guitar shown in FIG. 1, showing a pickup according to the invention installed under the saddle in the saddle slot.
Figure 3B:
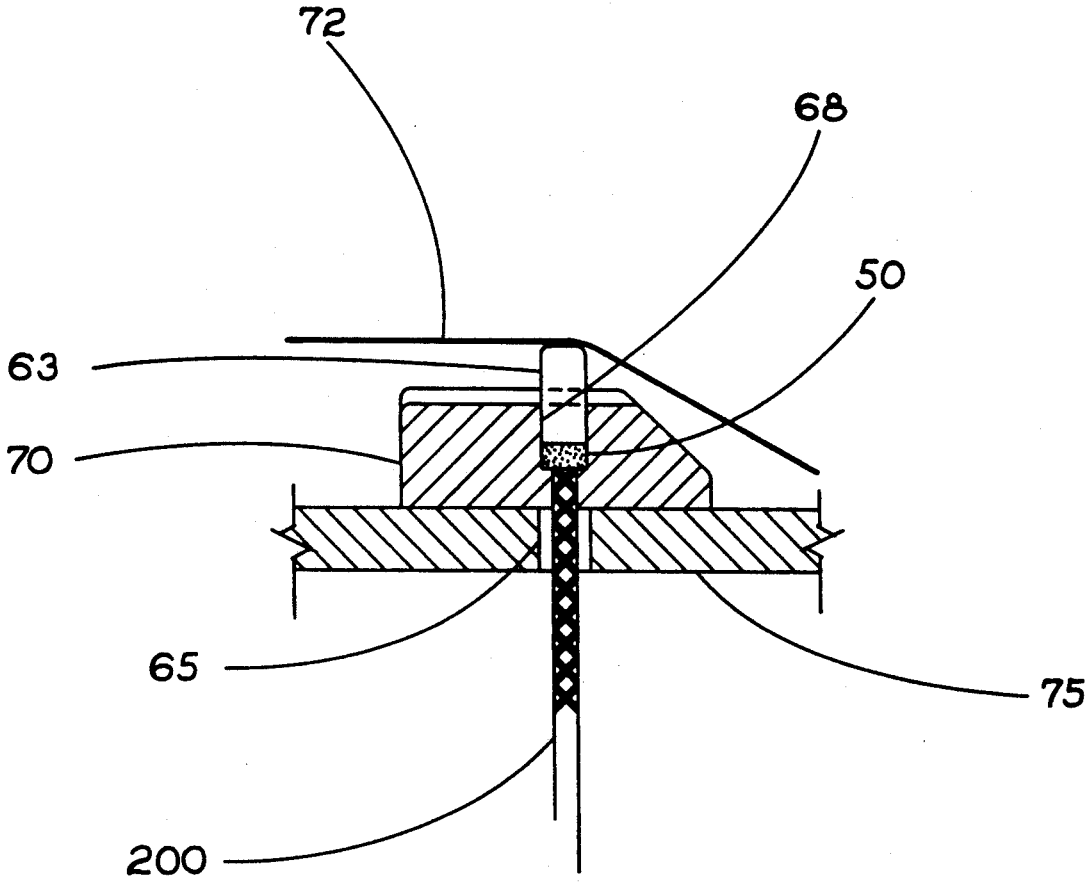

FIGS. 3(*a*) and 3(*b*) show cross-sectional views of the pickup installed in saddle-slot 68 of the bridge 70 of a guitar, the top of which is shown as 75. The pickup is installed in a guitar by de-tensioning strings 72, and removing saddle 63. Hole 65, about the same diameter as the width of saddle slot 68 (3/32" or approximately 2.4 mm), is drilled through bridge 70 and the top 75 of the guitar at one end of saddle slot 68. About 1/16" (1.6 mm) of material is removed from the bottom of saddle 63, to reduce the height of saddle 63 by the thickness of the transducer part 50 of the pickup. Output lead 200 is threaded through hole 65, and transducer 50 is installed at the bottom of saddle slot 68. Saddle 63 is then re-inserted in saddle slot 68, strings 72 are re-tensioned and the guitar re-tuned. Transducer part 50 of the pickup sits at the bottom of saddle slot 68 in bridge 70 and is sandwiched between the bottom of saddle 63 and the bottom of saddle slot 68. Because the height of saddle 63 is reduced to compensate for the thickness of transducer 50 in the bottom of saddle slot 68, the distance from the top 75 of the guitar to the top of saddle 63 (and hence the height of strings 72 above top 75) is the same as it was before pickup 60 was installed.

Figure 4A:
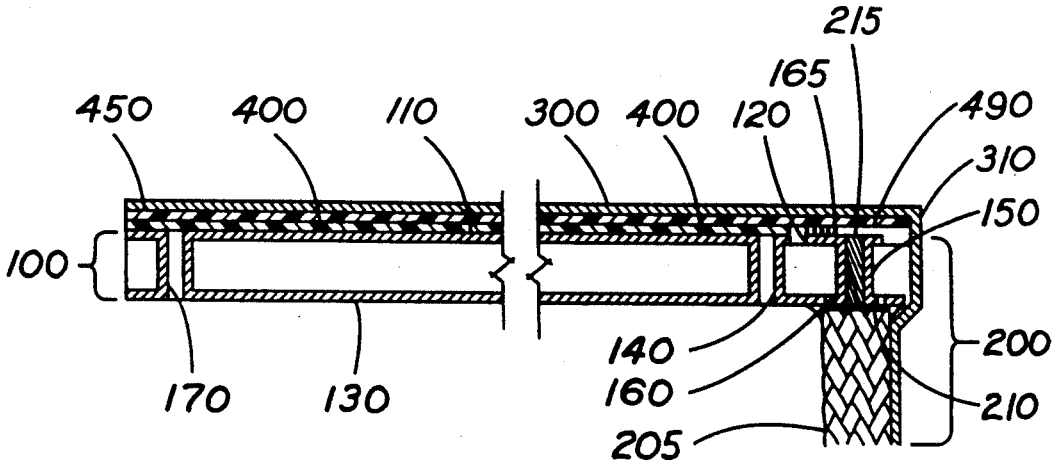
FIG. 4(*a*) is a longitudinal cross section of the preferred embodiment of the pickup according to the invention.
Figure 4B:
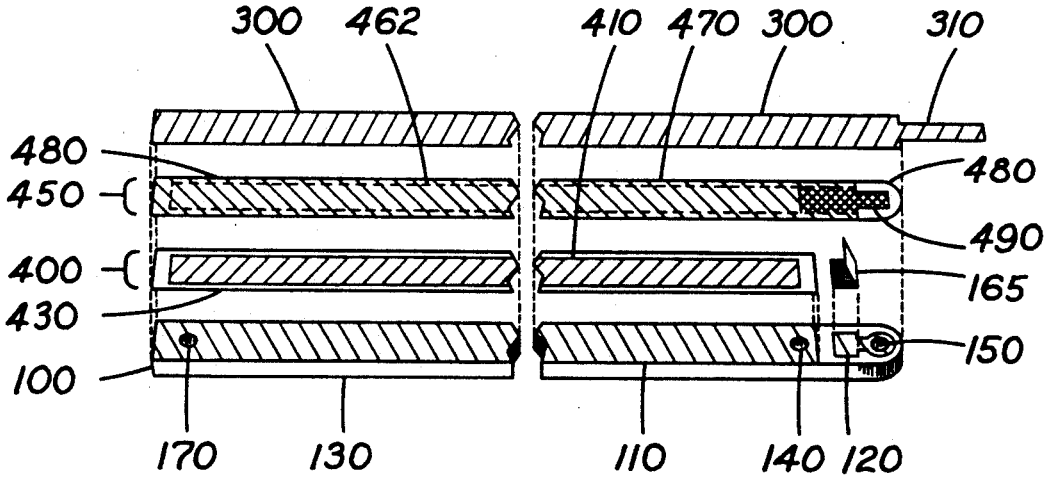

The structure of a pickup according to the preferred embodiment of the invention will now be described with reference to FIG. 4. FIG. 4(*a*) is a longitudinal cross section of the preferred embodiment of a pickup according to the invention showing the basic arrangement of core 100, output lead 200, contact strip 300, lower piezoelectric transducer element 400, and upper piezoelectric transducer element 450. Core 100 has a first face that is divided into two conducting areas, contact area 110 and output lead connecting area 120, that are isolated from one another by an insulating area. Second face 130 is electrically conducting over most of its area and is connected to contact area 110 by means of at least one plated-through hole 140. A further plated-through hole 150 electrically interconnects output lead connecting area 120 with conducting annulus 160. Conducting annulus 160 is electrically isolated from second face 130. More details of core 100 are given below in connection with the description of FIG. 6.

Inner conductor 215 of output lead 200 is inserted into plated-through hole 150, and is mechanically attached and electrically connected to plated-through hole 150, preferably by soldering. Inner conductor 215 is thus electrically connected to output lead contact area 120. Outer conductor 205 of output lead 200 is mechanically attached and electrically connected to anchor pad 194, again preferably by soldering. Anchor pad 194 is part of second face 130, thus, outer conductor 205 is in electrical contact with second face 130, and, via plated-through hole 140, to contact area 110 on the first face of core 100. Thus, both conductors of output lead 200 are mechanically attached to core 100, and make electrical contact with different conductive areas of core 100.

FIG. 4(*b*) is an exploded view showing core 100, lower and upper piezoelectric transducer elements 400 and 450 respectively, and contact strip 300.

Piezoelectric transducer elements 400 and 450 have substantially the same width as the first face of core 100. The length of lower piezoelectric transducer element 400 is substantially equal to the length of contact area 110 of the first face of core 100; the length of upper piezoelectric transducer element 450 is substantially equal to the length of core 100. Lower piezoelectric transducer element 400 comprises a strip of piezoelectric film 430 with first electrode 410 deposited on one side and second electrode 420 (not shown) deposited on and substantially completely covering the other side. Upper piezoelectric transducer element 450 comprises a strip of piezoelectric film 480 with first electrode 460 (not shown, but the periphery of first electrode 460 is shown by dotted line 462) deposited on one side and second electrode 470 deposited on and substantially completely covering the other side. The periphery of the first electrode (410 or 460) of each piezoelectric transducer element is inset from periphery of the film (430 or 480, respectively) on which it is deposited so that when the piezoelectric transducer elements are stacked with their first electrodes in contact, second electrodes 420 and 470 (which do extend to the periphery of the film) shield first electrodes 410 and 460 more effectively.

Lower piezoelectric transducer element 400 is placed on the first face of core 100 so that second electrode 420 (not shown) covers contact area 110. Upper piezoelectric transducer element 450 is placed on top of lower piezoelectric transducer element 400 so that it completely covers core 100 and first electrode 460 (not shown) of upper piezoelectric transducer element 450 contacts first electrode 410 of lower piezoelectric transducer element 400. The part 490 of first electrode 460 that is not covered by first electrode 410 overlaps output lead connecting area 120. Contacting means 165 ensures a reliable electrical contact between the exposed part 490 of first electrode 460 and output lead connecting area 120. A shim of metal or conducting plastic affixed to output lead connecting area 120 with conductive adhesive will serve as contacting means 165; alternatively, a small drop of conductive silicone can be used. In the preferred embodiment, a piece of self-adhesive copper tape folded in half is used. This arrangement connects first electrodes 410 and 460 (not shown) of piezoelectric transducer elements 400 and 450 respectively to output lead connecting area 120 and hence to inner conductor 215 of output lead 200 (FIG. 4(*a*)). More details of piezoelectric transducer elements 400 and 450 are given below in connection with the description of FIG. 8.

Contact strip 300 has substantially the same width as core 100, but is somewhat longer. Contact strip 300 is made from pliable metal foil or conductive plastic foil. Extension 310 of contact strip 300, which is preferably somewhat narrower than contact strip 300, is secured to the outer conductor of output lead 200 by solder, a conductive adhesive, or crimping. Contact strip extension 310 is bent to cover the exposed end of core 100, and is further bent through approximately 90 degrees to bring it into contact with second electrode 470 of second piezoelectric transducer element 450 so as to substantially cover it, as shown in FIG. 4(*a*). Thus, contact strip 300 electrically connects second electrode 470 of upper piezoelectric transducer element 450 to outer conductor 205 of output lead 200, and hence to second electrode 420 of lower piezoelectric transducer element 400. The two piezoelectric transducer elements are thus connected in parallel. More details of contact strip 300 are given below in connection with the description of FIG. 9.

Figure 5:
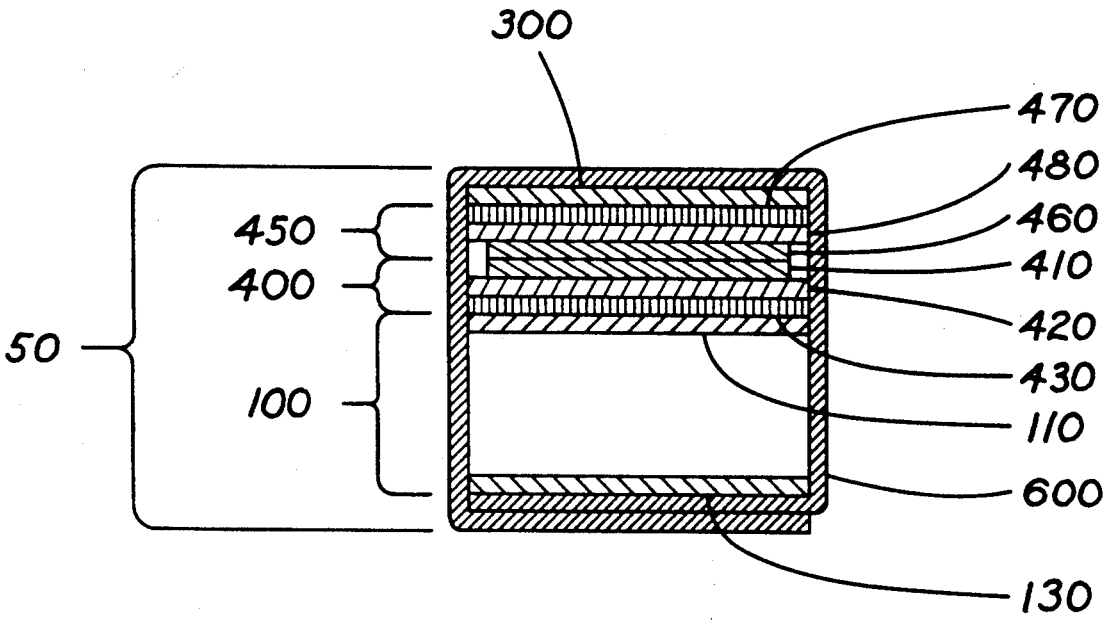
FIG. 5 is a transverse cross sectional view of the transducer part of the preferred embodiment of a pickup according to the invention.

The components of the transducer part 50 of the pickup (FIG. 2), i.e., core 100, piezoelectric transducer elements 400 and 450, and contact strip 300 (FIG. 4(*a*)), are assembled essentially without adhesives to prevent the cushioning effect of several layers of adhesive from reducing the output of the pickup. Transducer part 50 of the pickup is wrapped in an insulating layer to hold its components together. The insulating layer also physically protects and electrically insulates the transducer part 50 of the pickup. FIG. 5 shows a transverse cross section of the transducer part 50 of the pickup showing insulating layer 600 wrapped around it. To hold insulating layer 600 tightly wrapped around transducer 50, insulating layer 600 is wrapped 1 and ¼ times around transducer 50, such that there is an overlap of insulating layer 600 on the bottom of transducer 50. Paper with an adhesive applied in the overlap area works well as insulating layer 600; a plastic adhesive tape such as Scotch brand Magic TM tape can also be used. In the preferred embodiment, thin (0.002" (0.05 mm)) self-adhesive label paper is used.

Figure 6A:
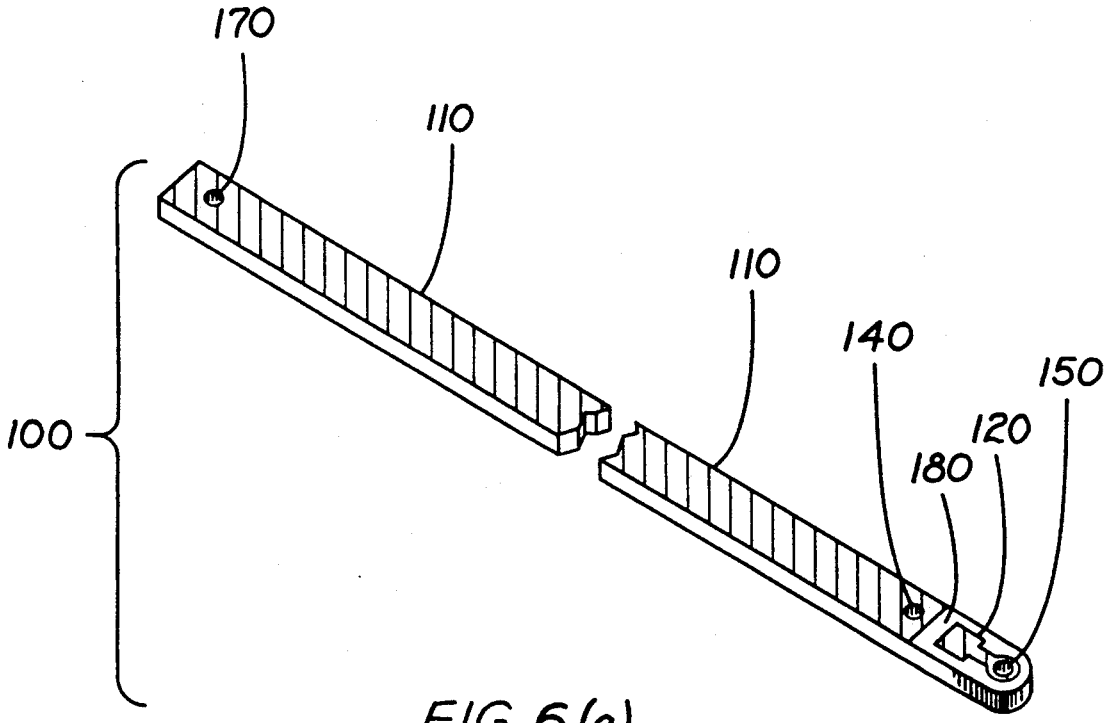
FIG. 6(*a*) is a perspective view of the first face of the core of the preferred embodiment of a pickup according to the invention.
Figure 6B:
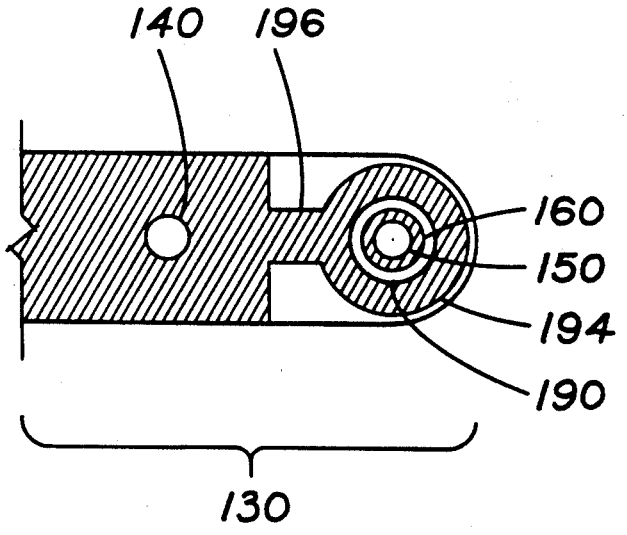

The six basic components of the pickup will now be described in turn: core 100, output lead 200, contact strip 300, piezoelectric transducer elements 400 and 450 and insulating layer 600. FIG. 6(*a*) shows core 100. Core 100 is an essentially rectangular piece of 1/32" (0.8 mm) thick material. The length of the core is substantially equal to the length of the saddle slot; in the preferred embodiment, which is suitable for most acoustic guitars, the length of the core is about 2.73" (69.3 mm). The preferred width of the core of a pickup for use in a standard 3/32" (2.4 mm) wide saddle slot is 0.075" (1.9 mm); the preferred width of the core of a pickup for a wider-than-standard ⅛" (3.2 mm) wide saddle slot is 0.110" (2.8 mm). Preferably, at least the end of core 100 to which output lead 200 will be attached is rounded, as shown in FIG. 6(*a*); alternatively, one or both ends can be straight-cut. A variety of materials can be used for core 100, the main purposes of which are to support the other components of the pickup, to provide the pickup with physical strength, to interconnect the electrodes of piezoelectric transducer elements 400 and 450 and the conductors 205 and 215 of output lead 200, and to anchor output lead 200.

The preferred embodiment uses a fibre-glass core with two conductive surfaces cut from a sheet of fibreglass printed circuit board clad on both sides with 1 ounce per square foot (0.3 kg per square meter) of copper, the overall thickness of the board being 1/32" (0.8 mm). Before the sheet of printed circuit board is cut into individual cores, the sheet is drilled with at least two 0.030" (0.75 mm) diameter holes per core. Hole 150 is located in the part of core 100 that will become output lead connecting area 120, and hole 140 is located in the part of core 100 that will become contact area 110. In the preferred embodiment, a further hole 170 is located in the part of core 100 that will become contact area 110. All holes are plated-through using plating techniques well known in the art.

Also, before the sheet of printed circuit board is cut into individual cores, copper is selectively removed from both sides of the board to form the metallization patterns required for each core. Copper removal is preferably done by a mask-and-etch process well known in the art. Copper is removed from a narrow strip 180 of the first face of the core to divide the first face into contact area 110 and output lead connecting area 120. Preferably, copper is also removed from the periphery of output lead connecting area 120 to provide the shape shown in FIG. 6(*a*).

Although copper may be almost entirely removed from the second face of core 100, leaving only annulus 160, anchor pad 194 and a track interconnecting anchor pad 194 and plated-through hole 140, it is preferred to leave second face 130 almost completely covered with copper. Leaving second face 130 substantially completely covered with copper enables second face 130 to provide some electrical shielding, and gives the pickup a flat bottom surface, which helps the pickup seat snugly in the bottom of saddle slot 68 (FIG. 3(*b*)). Thus, it is preferred that copper be removed from second face 130 only as shown in FIG. 6(*b*). Copper is removed from annular area 190 surrounding annulus 160 and plated-through hole 150 to isolate annulus 160, hole 150, and output lead connecting area 120 (FIG. 4(*a*)) from second face 130. It is also preferred to remove copper from second face 130 to form anchor pad 194 surrounding annular area 190. Anchor pad 194 facilitates soldering outer conductor 205 of output lead 200 to second face 130. The inner diameter of lead anchor pad 194 is preferably substantially the same as the outer diameter of inner insulator 210 of output lead 200 (FIG. 4(*a*)). The outer diameter of anchor pad 194 is preferably substantially the same as the width of core 100. Anchor pad 194 is connected to the rest of second face 130 by track 196.

In the preferred embodiment, both sides of the sheet of printed-circuit board are plated with 20 μ" (0.5 μm) of gold to prevent tarnishing and the formation of a rectifying contact between contact area 110 of core 100 and second electrode 420 of lower piezoelectric transducer element 400. Anchor pad 194 is also tinned to facilitate soldering the outer conductor 205 of output lead 200 to it.

The sheet of printed circuit board then cut into individual cores with the above-stated dimensions. Alternatively, the sheet of printed circuit board can be cut up into individual cores before the gold plating, hole-drilling, copper removal, plating-through, and lead anchor pad tinning operations.

Figure 7:
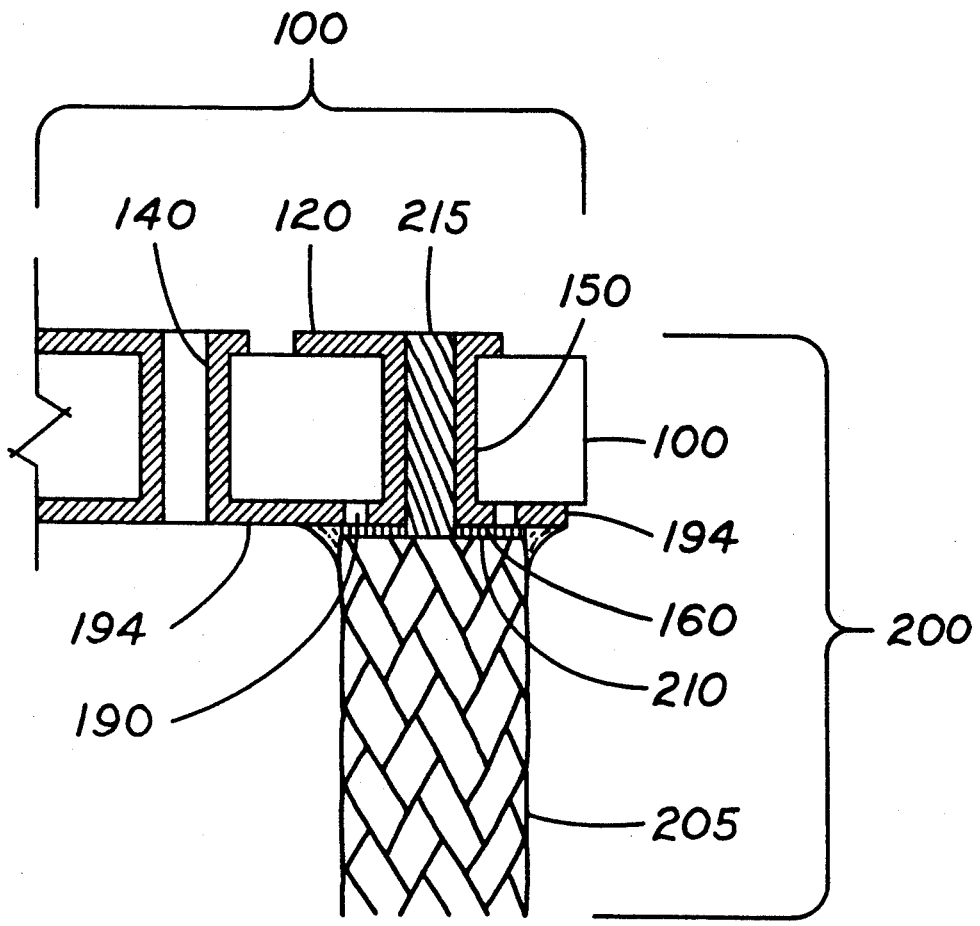
FIG.7 is a longitudinal cross sectional view of part of the preferred embodiment of a pickup according to the invention, showing how the output lead is attached to the core.

The assembly of output lead 200 and core 100 is shown in FIG. 7. Output lead 200 is a suitable length (usually about 15" (0.4 m)) of subminiature co-axial cable about 1/16" (1.6 mm) in diameter. Coaxial cable is required to prevent output lead 200 from picking up hum and other unwanted noise. Outer conductor 205 and insulator 210 of output lead 200 are stripped back using known techniques to expose about 1/16" (1.6 mm) of inner conductor 215. Inner conductor 215, and, if it is to be soldered, outer conductor 205, are prepared for soldering using well-known techniques. If output lead 200 is to be soldered to core 100 using normal temperature solder, as is preferred, this must be done before piezoelectric transducer elements 400 and 450 (FIG. 4(*a*)) are placed on core 100, otherwise the temperatures required to melt normal temperature solder will melt the piezoelectric film of the transducer elements. Alternatively, output lead 200 can be soldered to core 100 using a low-temperature (<90° C.) indium-tin solder. Inner conductor 215 is pushed through hole 150 and soldered using well-known techniques. Soldering may be carried out by hand after the printed circuit board has been cut into individual pieces, before piezoelectric transducer elements 400 and 450 are placed on core 100, or, using low-temperature solder, after the transducer elements are placed on the core. Alternatively, output lead 200 may be soldered to core 100 by flow-soldering before the sheet of printed circuit board is cut into individual cores. Inner conductor 215 may also be attached to core 100 by electric welding.

When core 100 has the preferred lead anchor pad 194, output lead 200 is stripped through outer conductor 205 and insulator 210 to expose about 1/32" (0.8 mm) of inner conductor 215. When the lead has been stripped, insulator 210 should not be visible when the lead is viewed from the side. Care must be taken to ensure that outer conductor 205 is cut cleanly, so that no uncut strands of outer conductor 205 come into contact with inner conductor 215. Exposed inner conductor 215 and outer conductor 205 in the vicinity of exposed inner conductor 215 are then tinned. Inner conductor 215 is then inserted into plated-through hole 150 so that the tinned end of outer conductor 205 comes into contact with anchor pad 194. Heat and solder are then applied to solder inner conductor 215 to hole 150 and heat is applied to sweat-solder tinned outer conductor 205 to tinned anchor pad 194, as shown in FIG. 7.

Irrespective of the method used to attach output lead 200 to core 100, care must be taken to ensure that nothing (e.g., inner conductor 215 and/or, solder) protrudes from the top of plated-through hole 150. This is to ensure that the bottom of saddle 63 (FIG. 3(*a*)) contacts the top face of the pickup evenly along the whole of its length.

Figure 9A:
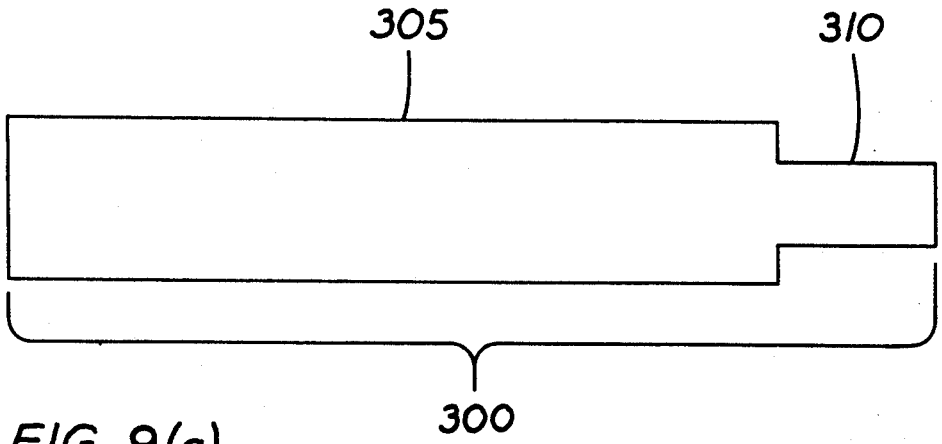
FIG. 9(*a*) shows a plan view of the contact strip of a pickup according to the invention before the contact strip extension is bent through 90 degrees.
Figure 9B:
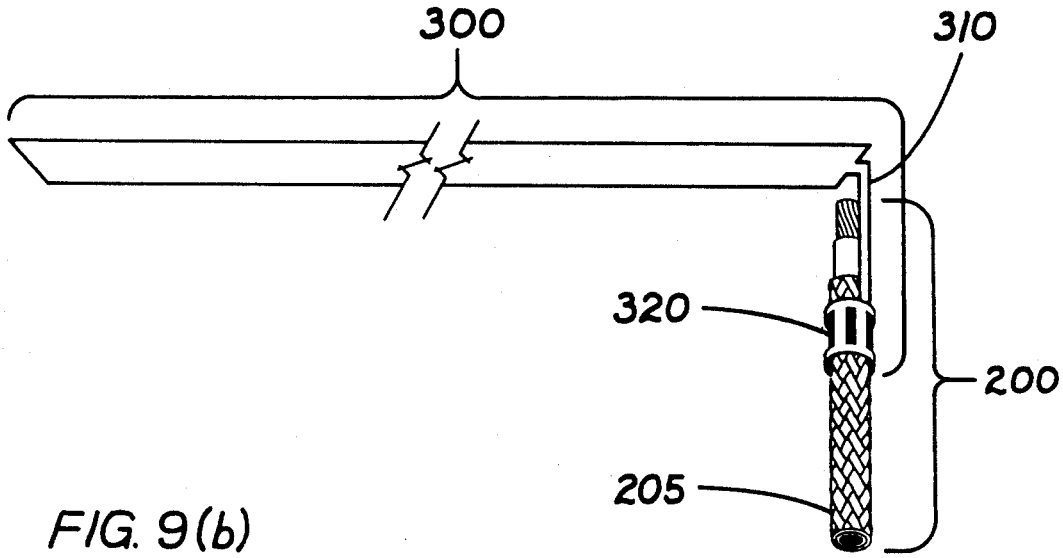
Figure 9C:
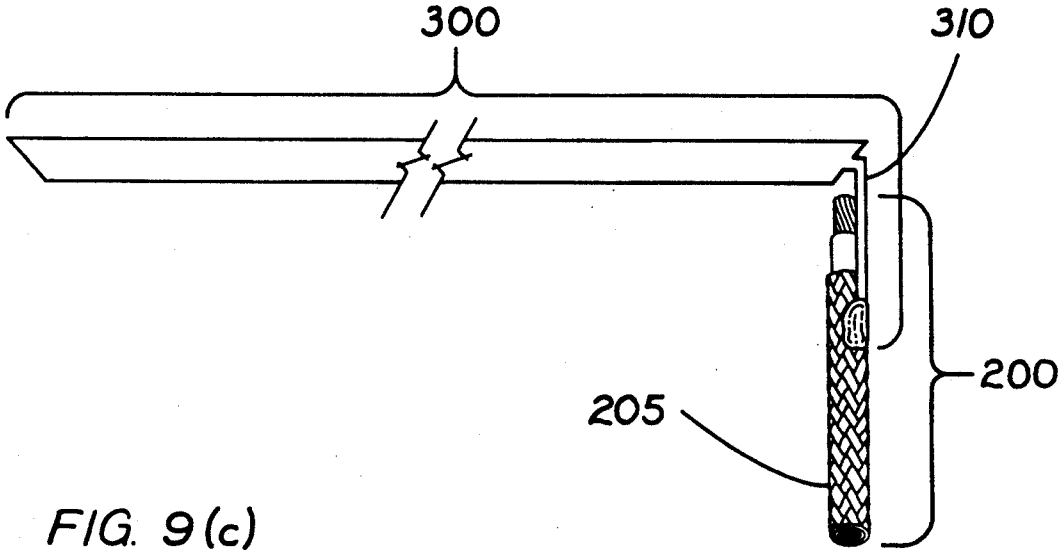

A plan view of contact strip 300 is shown in FIG. 9(*a*). Contact strip 300 includes a rectangular piece of approximately 0.002" (0.05 mm) thick foil 305 cut to substantially the same width as the first face of the core and about ¼" (6.25 mm) longer. Copper, brass, metallized plastic, or some suitable conductive material may be used for foil 305. The width of foil 305 is reduced to about 1/32" (0.8 mm) over the last ¼" (6.25 mm) of its length to form extension 310. Extension 310 is bent through 90 degrees relative to foil 305 as shown in FIGS. 9(*b*) and 9(*c*), and, if necessary, is bent inwards slightly so that it comes into contact with outer conductor 205 of output lead 200.

FIGS. 9(*b*) and 9(*c*) show various ways of attaching contact strip 300 to outer conductor 205 of output lead 200. One way of attaching output lead 200 to contact strip 300, and of providing a reliable electrical and mechanical connection is shown in FIG. 9(*b*). Crimp receptacle 320 is attached to extension 310 by soldering, welding, riveting, or some other way, and output lead 200 is crimped in crimp receptacle 320 using a suitable crimping tool. Crimp receptacle 320 can be made from beryllium copper but other materials well known in the art with suitable electrical and mechanical properties can be used. The main advantage of attaching contact strip 300 to output lead 200 by crimping is that crimping does not require heat that could melt piezoelectric transducer elements 400 and 450, or could otherwise distort the pickup. Alternatively, the complete contact strip comprising foil 305, extension 310, and crimp receptacle 320, can be formed from a single piece of beryllium copper foil or other suitable material. Output lead 200 is then crimped in crimp receptacle 320 using a suitable crimping tool.

In the preferred embodiment, contact strip 300 is attached to output lead 200 by soldering, as shown in FIG. 9(*c*). Outer conductor 205 of output lead 200 and extension 310 are tinned prior to assembly using techniques well known in the art, after which the two components are brought into contact and heat is applied to sweat solder them together. This is done before contact strip 300 is bent through 90 degrees and placed on upper piezoelectric transducer element 450 to avoid melting or otherwise distorting one or both piezoelectric transducer elements.

Figures 8A, 8B:
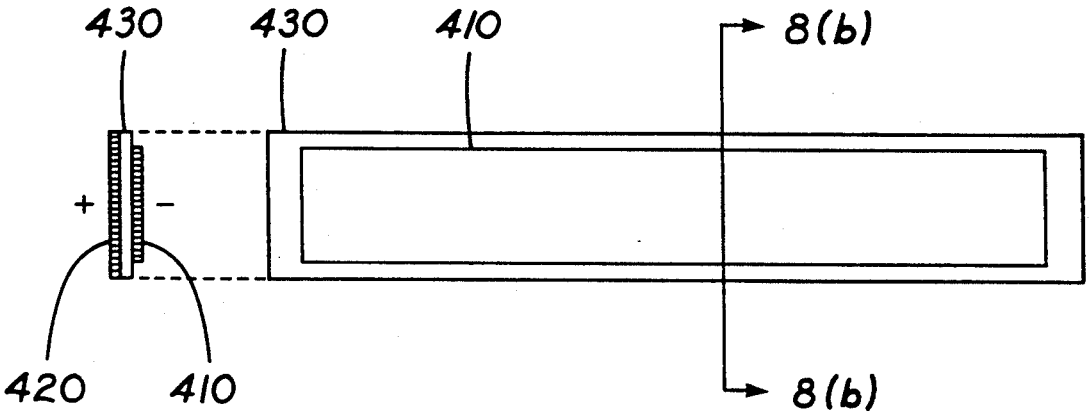
FIGS. 8(*a*)–8(*d*) show plan views of the piezoelectric transducer elements of the preferred embodiment of a pickup according to the invention.
Figures 8C, 8D:
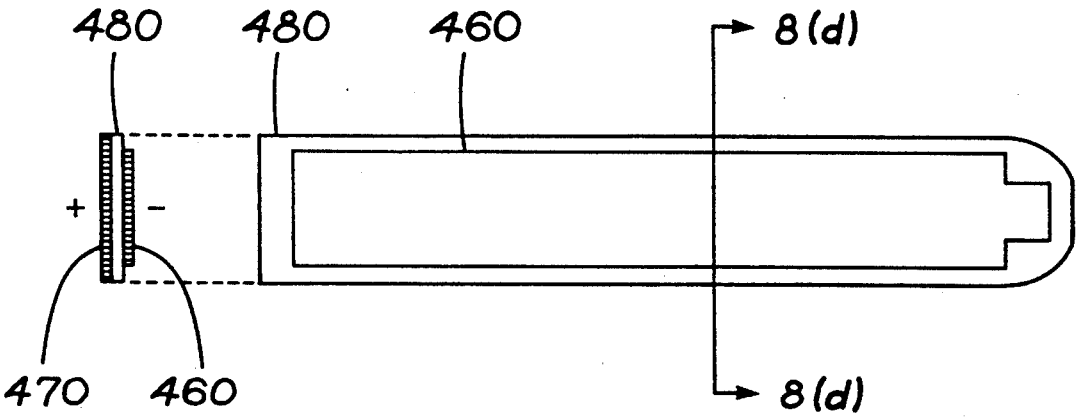

FIG. 8(*a*) shows a plan of lower piezoelectric transducer element 400 and FIG. 8(*b*) shows a cross section of lower piezoelectric transducer element 400. Lower piezoelectric transducer element 400 is formed by depositing first and second metal electrodes, 410 and 420 respectively, on an essentially rectangular piece of piezoelectric film 430. FIG. 8(*c*) shows upper piezoelectric transducer element 450 and FIG. 8(*d*) shows a cross section of upper piezoelectric transducer element 450. Upper piezoelectric transducer element is formed by depositing first and second metal electrodes, 460 and 470 respectively, on an essentially rectangular piece of piezoelectric film 480. For this application, a PVDF film such as that sold under the trademark "KYNAR" by Atochem Sensors, Inc. is the preferred material for the piezoelectric film. A thickness of 110 μm (about 0.004") gives the best compromise between output voltage and capacitance, and is thus preferred. A web of piezoelectric film is cut into individual films 430 and 480 by means of a knife, or, preferably, the web is die cut. The width of piezoelectric films 430 and 480 is substantially equal to the width of core 100 (FIG. 4). The length of piezoelectric film 430 in lower piezoelectric transducer element 400 is substantially equal to the length of contact area 110 of the first face of core 100, i.e., about 2.53" (64.3 mm) in the preferred embodiment. The length of piezoelectric film 480 in upper piezoelectric transducer element 450 is substantially equal to the length of core 100, i.e., about 2.70" (68.6 mm) in the preferred embodiment. The ends of piezoelectric film 480 are preferably cut to match the shape of core 100 as shown.

In lower piezoelectric transducer element 400, first electrode 410 is formed by partially covering one side of film 430 with a metallized layer applied by silk-screening with conductive ink, or by vacuum depositing a metallic layer. First electrode 405 is rectangular in shape and its edges are inset from the longer edges of film 430 by approximately 0.01" (0.25 mm), and from the shorter edges by approximately 0.03" (0.75 mm). Second electrode 420 is formed by fully covering the other side of film 430 with a metallized layer applied by silk-screening with conductive ink, or by vacuum depositing a metallic layer.

In upper piezoelectric transducer element 450, first electrode 460 is formed by partially covering one side of film 480 with a metallized layer applied by silk-screening with conductive ink, or by vacuum depositing a metallic layer. First electrode 460 is rectangular in shape and its edges are inset from the longer edges of film 430 by approximately 0.01" (0.25 mm), and from one of the shorter edges by approximately 0.032" (0.81 mm), and from the other of the shorter edges by about 0.065" (1.65 mm). Second electrode 470 is formed by fully covering the other side of film 480 with a metallized layer applied by silk-screening with conductive ink, or by vacuum depositing a metallic layer.

Referring to FIGS. 4(*a*) and 4(*b*), piezoelectric transducer elements 400 and 450 are stacked on core 100, which preferably has been pre-assembled with output lead 200 and contact strip 300, by placing lower piezoelectric transducer element 400 on core 100 such that its long edges are flush with the long edges of core 100, one of its ends is flush with the end of core 100 remote from output lead contacting area 120, and second electrode 420 is in contact with contact area 110.

Contacting means 165 is applied to output lead connecting area 120. A small drop of conductive silicone can be applied to output lead connecting area to provide contacting means 165; alternatively, a small piece of 0.002" (50 μm) thick metal (such as brass) or conductive plastic foil is attached to output lead connecting area 120 by means of a thin layer of conductive adhesive, such as type 9703 made by 3M Company. A second thin layer of conductive adhesive is applied to the exposed surface of the foil after the foil has been attached to output lead connecting area 120. In the preferred embodiment, contacting means 165 is a rectangular piece about 0.125" by 0.04" (3.2 mm by 1 mm) of about 0.003" (75 μm) thick self-adhesive copper tape, folded in half along its short axis with its adhesive side on the outside. The preferred copper tape is 3M Company type 1181, the adhesive layer of which is conducting. Contacting means 165 is placed on output lead connecting area 120 with its long axis aligned with the long axis of output lead connecting area 120.

Upper piezoelectric transducer element 450 is placed on top of lower piezoelectric transducer element 400 and core 100 such that it is flush with core 100 on all sides. This aligns first electrode 460 of upper piezoelectric transducer element 450 with first electrode 410 of lower piezoelectric transducer element 400. The part 490 of first electrode 460 that is not in contact with first electrode 410 makes contact with contact means 165, and hence with output lead connecting area 120 and inner conductor 215 of output lead 200 (FIG. 4(*a*)).

Electrical contact between second electrode 420 of lower piezoelectric transducer element 400 and second electrode 470 of upper piezoelectric transducer element 450 is established by bending contact strip 300 (which is already attached to output lead 200) through 90 degrees so that contact strip 300 contacts second electrode 470 of upper piezoelectric transducer element 450.

To hold the piezoelectric transducer elements 400 and 450 and contact strip 300 in place on core 100 prior to wrapping the pickup with insulating layer 600, a small drop of cyanoacrylate adhesive is placed on the exposed ends of piezoelectric transducer elements 400 and 450, contact strip 300 and core 100 remote from output lead 200. All excess adhesive is immediately removed by blotting with a piece of absorbent paper. This ensures that the adhesive is applied only to the very ends of the components and does not interfere with the electrical contact between the components.

Figure 10:
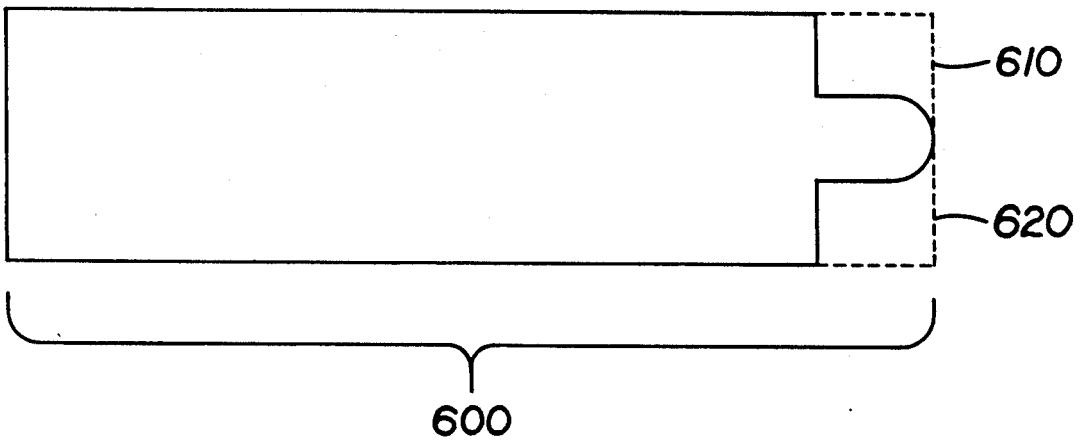
FIG. 10 shows a plan view of the insulating layer of the preferred embodiment of a pickup according to the invention.
Figure 11A:
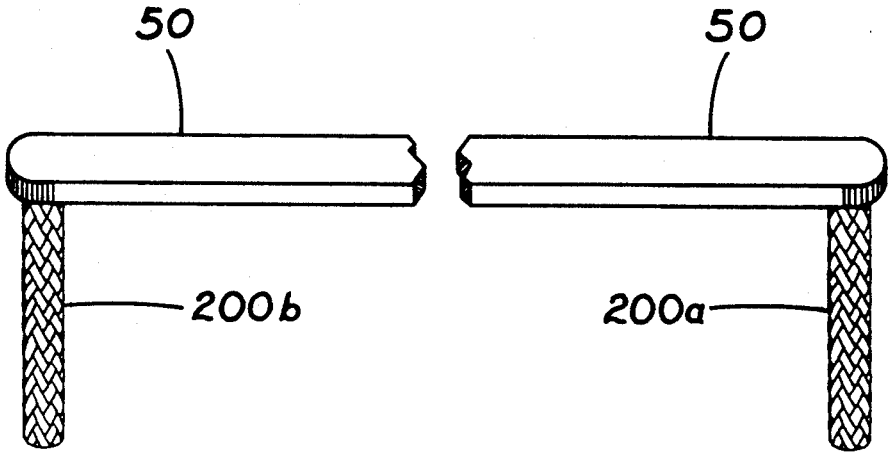
FIG. 11(*a*) shows a perspective view of a two output lead "stereo" version of the pickup according to the invention.
Figure 11B:
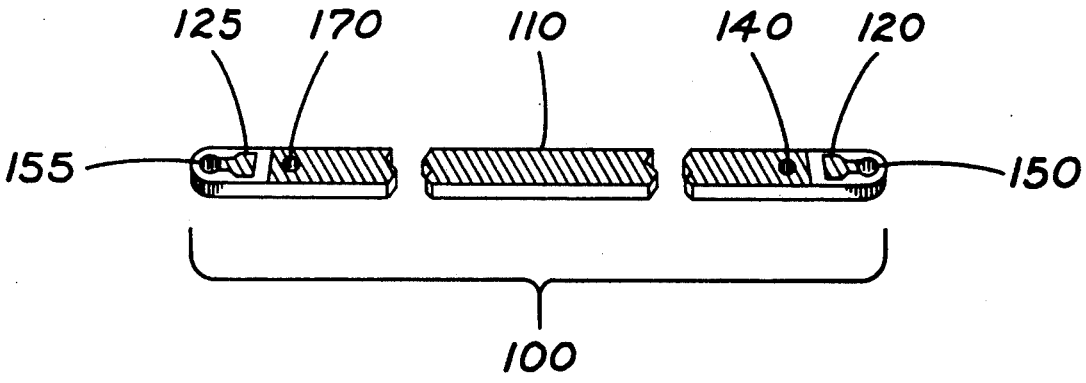
Figure 11C:
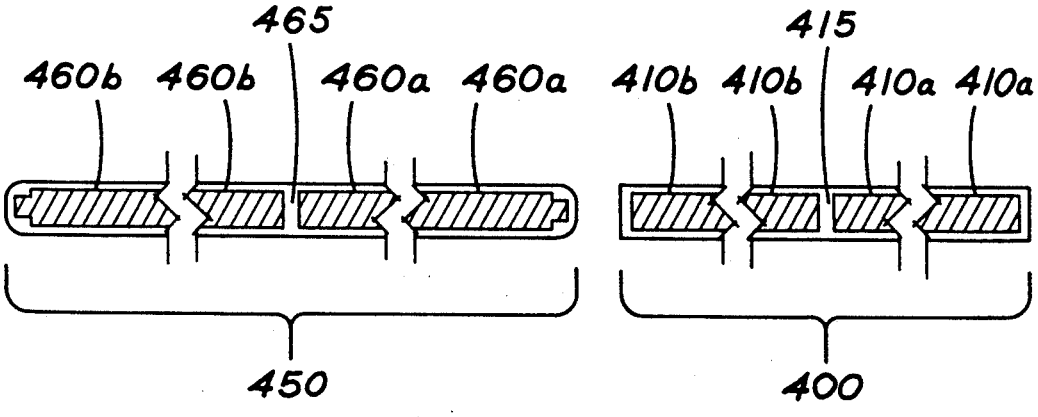
Figure 11D:
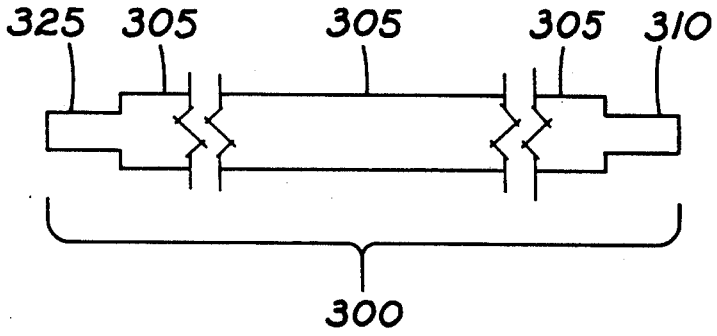
Figure 11E:
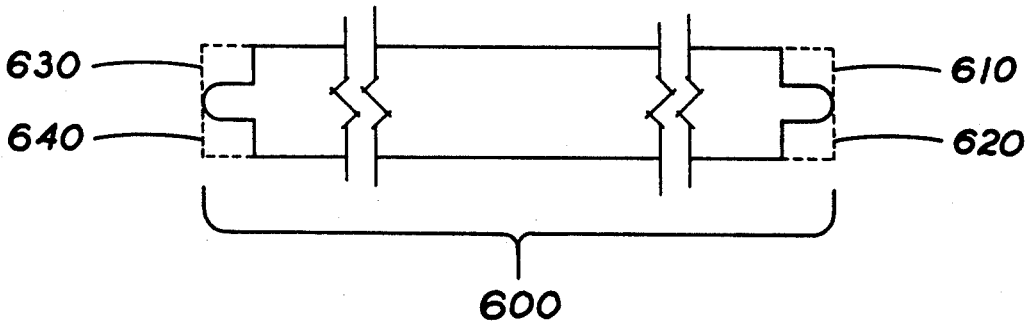

The pickup is completed by adding insulating layer 600. Insulating layer 600 provides electrical insulation and mechanical protection, and holds together the components of the transducer part 50 of the pickup (FIG. 2) (i.e., the core, piezoelectric transducer elements and contact strip). Insulating layer 600 comprises a piece of paper, plastic or other insulating material die cut to the shape shown in FIG. 10. The length of insulating layer 600 is substantially equal to that of core 100, i.e., 2.7" (68.6 mm) in the preferred embodiment. Its length is reduced by about 0.1" (2.5 mm) in cut-out areas 610 and 620 to provide an aperture for output lead 200 when the insulating layer is wrapped around transducer 50. The width of insulating layer 600 is equal to three times the width plus twice the thickness of transducer 50, i.e., about 0.435" (11 mm) for the normal 3/32" (2.4 mm) wide version. Insulating layer 600 may be scored at the points at which it coincides with the corners of transducer 50 to make it easier to wrap. A non-adhesive plastic film or paper can be used for insulating layer 600, the layer being secured with a thin film of a suitable adhesive applied at least in the area covering the bottom of the pickup where there is a double thickness of insulating layer. A self-adhesive film of plastic or paper, such as 3M Company Magic TM adhesive tape, can also be used for insulating layer 600. In the preferred embodiment, 0.002" (50 μm) thick self-adhesive label paper, 3M Company type 7109, is used. A suitably shaped piece of label paper is cut and placed symmetrically on top of the assembled pickup. One of the protruding sides of the tape is wrapped down the side and across the bottom of transducer 50, then the other protruding side of the tape is wrapped down the other side and across the bottom of transducer 50. This envelops transducer 50 and provides two layers of tape on the bottom of transducer 50.

Insulating layer 600 leaves unprotected the sides and end of the pickup in the vicinity of output lead 200. This part of the pickup is protected by painting it with a layer of opaquing fluid for copies. A water-based opaquing fluid, such as Liquid Paper ® Just for Copies ® opaquing fluid is preferred. After the opaquing fluid has dried, a layer of cyanoacrylate adhesive is applied to its surface. This considerably increases the hardness and durability of the dried opaquing fluid. Finally, the transducer part of the pickup is painted with a conductive paint. The conductive paint provides further electrical shielding for the pickup, although, for most applications, this extra shielding is unnecessary since the core, the contact strip, and the second electrodes of the piezoelectric transducer elements provide sufficient electrical shielding. The painted area extends over the outer conductor of the output lead in the vicinity of the transducer part of the pickup to provide an electrical connection between the conductive paint layer and the outer conductor of the output lead.

The basic pickup described above can be adapted to make a "stereo" pickup, in which the three lower-frequency strings are represented electrical output signal, and the three upper-frequency strings are represented by another electrical output signal. Such a pickup has two output leads 200*a* and 200*b* respectively, one for each output signal, attached to opposite ends of core 100, as shown in FIG. 11(*a*).

Core 100 has a symmetrical shape, as shown in FIG. 11(*b*). The area of contact area 110 is reduced so that a second output lead connecting area 125 can be located the end of the first face of core 100 remote from first output lead connecting area 120. Second output lead connecting area 125 is identical to first output lead connecting area 120 and includes plated-through hole 155. First and second contacting means 165 and 167 (not shown) are placed on first and second output lead connecting areas 120 and 125 respectively, as described as above. Second face 130 of core 100 preferably includes at the end remote from first anchor pad 194 a second structure, including second anchor pad 195 (not shown), identical to that shown in FIG. 6(*b*).

A coaxial output lead is attached to each end of core 100, as follows. The inner conductor of one output lead is inserted into plated-through hole 150, and the inner conductor of the other output lead is inserted into plated-through hole 155. Both inner conductors are attached to their respective plated-through holes preferably by soldering, as previously described. The outer conductor of the one output lead is attached to second face 130 of core 100, preferably by soldering to first anchor pad 194, and the outer conductor of the other output lead is attached to second face 130 of core 100, preferably by soldering to second anchor pad 195, as previously described.

First electrode 410 of lower piezoelectric transducer element 400 is divided by non-metallized area 415 half-way along its length into two sub-electrodes, 410*a* and 410*b*, and first electrode 460 of upper piezoelectric transducer element 450 is divided by non-metallized area 465 half-way along its length into two sub-electrodes, 460*a* and 460*b*, as shown in FIG. 11(*c*). The second electrodes of the piezoelectric transducer elements are not changed. The length of lower piezoelectric transducer element 400 is reduced by about 0.17" (4.3 mm) to account for the shorter length of contact area 110 of core 100. The shorter length of lower piezoelectric transducer element 400 enables sub-electrode 460*a* to contact first output lead connecting. area 120 via contacting means 165, and sub-electrode 460*b* to contact second output lead connecting area 125 via contacting means 167 when upper piezoelectric transducer element 450 is placed on top of lower piezoelectric transducer element 400.

Contact strip 300 has a second extension 325 on the end opposite to first extension 310, as shown in FIG. 11(*d*). Contact strip 300 is stacked on top of second electrode 470 of upper piezoelectric transducer element 450 as described above. First extension 310 is bent through 90 degrees and is attached to the outer conductor of first output lead 200*a* as described above. Similarly, second extension 325 is bent through 90 degrees and is attached to the outer conductor of second output lead 200*b*.

Insulating layer 600 and its application to the transducer part of the pickup is the same as in the basic version of the pickup, except that, as shown in FIG. 11(*e*), additional cut-outs 630 and 640 are made to provide an aperture for second output lead 200*b*.

When the "stereo" pickup is installed in the guitar, an additional 3/32" (2.4 mm) hole must be drilled at the end of bridge slot 68 (FIG. 3*a*) remote from hole 65 to accommodate second output lead 200*b*. It can be seen that, depending on which way round the pickup is installed in the bridge slot of the guitar, the electrical signal on first output lead 200*a* will represent mainly the output from, say, the lower-frequency three strings, and the electrical signal from second output lead 200*b* will represent mainly the output from, say, the upper-frequency three strings, or vice versa.

Although the above description describes a "stereo" pickup with two symmetrical outputs, each output of the pickup representing the output from three strings, the basic techniques described can be used in asymmetrical pickups, in which one of the outputs reproduces the output from fewer than three strings.

I claim:

1. An electro-mechanical pickup for a musical instrument having a plurality of strings, comprising:

an elongated multi-faced core having a first face opposite a second face, a first piezoelectric transducer element connected in parallel with a second piezoelectric transducer element, each piezoelectric transducer element comprising:

a piezoelectric film having a first surface and a second a piezoelectric film having a first surface and a second surface, a first electrode on the first surface, and a second electrode on the second surface, each piezoelectric transducer element being responsive to more than one string, the first piezoelectric transducer element being stacked on the core with the second electrode of the first piezoelectric transducer element in contact with the first face, and the second piezoelectric transducer element being stacked on the first piezoelectric transducer element with the first electrode of the second transducer element in contact with the first electrode of the first piezoelectric transducer element, and an output lead attached to the core, the output lead having a first conductor and a second conductor, the first conductor electrically contracting the first electrode of the first piezoelectric transducer element and the first electrode of the second piezoelectric transducer element, and the second conductor electrically contacting the second electrode of the first piezoelectric transducer element and the second electrode of the second piezoelectric transducer element.

2. The pickup of claim 1 wherein the first face of the core is conducting and comprises a contact area and an output lead connecting area, the first electrode of the second piezoelectric transducer element is in electrical contact with the output lead connecting area, the second electrode of the first piezoelectric transducer element is in electrical contact with the contact area, and the first conductor of the output lead is attached to and is in electrical contact with the output lead connecting area.

3. The pickup of claim 2 wherein the second face of the core is conducting and includes an anchor pad, the second conductor of the output lead is attached to and is in electrical contact with the anchor pad, and the second face of the core is electrically connected to the contact area.

4. The pickup of claim 3 further comprising a contact strip stacked on the second piezoelectric transducer element, the contact strip electrically connecting the second electrode of the second piezoelectric transducer element to the second conductor of the output lead.

5. The pickup of claim 4 wherein the length and width of the first piezoelectric transducer element are substantially equal to the length and width of the contact area, and the length and width of the second piezoelectric transducer element are substantially equal to the length and width of the core.

6. The pickup of claim 2 further comprising a contact strip stacked on the second piezoelectric transducer element, the contact strip electrically connecting the second electrode of the second piezoelectric transducer element to the second conductor of the output lead.

7. The pickup of claim 6 wherein the length and width of the first piezoelectric transducer element are substantially equal to the length and width of the contact area, and the length and width of the second piezoelectric transducer element are substantially equal to the length and width of the core.

8. The pickup of claim 2 wherein the length and width of the first piezoelectric transducer element are substantially equal to the length and width of the contact area, and the length and width of the second piezoelectric transducer element are substantially equal to the length and width of the core.

9. The pickup of claim 1 wherein the second face of the core is conducting and includes an anchor pad, the second conductor of the output lead is attached to and is in electrical contact with the anchor pad, and the second face of the core is electrically connected to a contact area on the first face of the core.

10. The pickup of claim 9 further comprising a contact strip stacked on the second piezoelectric transducer element, the contact strip electrically connecting the second electrode of the second piezoelectric transducer element to the second conductor of the output lead.

11. The pickup of claim 10 wherein the length and width of the first piezoelectric transducer element are substantially equal to the length and width of the contact area, and the length and width of the second piezoelectric transducer element are substantially equal to the length and width of the core.

12. The pickup of claim 9 wherein the length and width of the first piezoelectric transducer element are substantially equal to the length and width of the contact area, and the length and width of the second piezoelectric transducer element are substantially equal to the length and width of the core.

13. The pickup of claim 1 further comprising a contact strip stacked on the second piezoelectric transducer element, the contact strip electrically connecting the second electrode of the second piezoelectric transducer element to the second conductor of the output lead.

14. The pickup of claim 13 wherein the first face of the core is conducting and comprises a contact area and an output lead connecting area the length and width of the first piezoelectric transducer element are substantially equal to the length and width of the contact area, and the length and width of the second piezoelectric transducer element are substantially equal to the length and width of the core.

15. The pickup of claim 1 wherein the first face of the core is conducting and comprises a contact area and an output lead connecting area, the length and width of the first piezoelectric transducer element are substantially equal to the length and width of the contact area, and the length and width of the second piezoelectric transducer element are substantially equal to the length and width of the core.

16. The pickup of claims 1, 2, 3, 6, 8, 9, 10, 12, 13, 14, or 15 wherein, in each piezoelectric transducer element, the second electrode covers substantially all of the second surface of the piezoelectric film, and the periphery of the first electrode is inset from the periphery of the piezoelectric film.

17. The pickup of claim 13 wherein the core, first piezoelectric transducer element, second piezoelectric transducer element and contact strip are covered with an insulating layer.

18. The pickup of claim 17 wherein the insulating layer comprises an essentially rectangular piece of paper wrapped one and one-quarter times around the core, first piezoelectric transducer element, second piezoelectric transducer element, and contact strip and secured by a thin layer of adhesive applied in the area where the insulating layer overlaps itself.

19. The pickup of claim 17 wherein the insulating layer comprises an essentially rectangular piece of self-adhesive film wrapped one and one-quarter times around the core, first piezoelectric transducer element, second piezoelectric transducer element, and contact strip.

20. An electro-mechanical pickup for a musical instrument having a plurality of strings, comprising:

an elongated multi-faced core having a first face opposite a second face, each face being conductive over a substantial portion of the area of each face, the first face comprising a contact area and an output lead connecting area separated by an insulating area, the second face comprising an anchor pad, the second face being electrically connected to the contact area, a first piezoelectric transducer element connected in parallel with a second piezoelectric transducer element, each piezoelectric transducer element comprising a piezoelectric film having a first surface and a second surface, a first electrode on the first surface, the periphery of the first electrode being inset from the periphery of the first surface, and a second electrode substantially covering the second surface, each piezoelectric transducer element being responsive to more than one string, the length and width of the first piezoelectric transducer element being substantially equal to the length and width of the contact area, the first piezoelectric transducer element being stacked on the core with the second electrode of the first piezoelectric transducer element substantially covering and in electrical contact with the contact area, the length and width of the second piezoelectric transducer element being substantially equal to the length and width of the core, and the second piezoelectric transducer element being stacked on the first piezoelectric transducer element with the first electrode of the second piezoelectric transducer element substantially covering and in electrical contact with the first electrode of the first piezoelectric transducer element, and substantially covering and in electrical contact with the output lead connecting area, an output lead having a first conductor and a second conductor, the first conductor being attached to and in electrical contact with the output lead connecting area, and the second conductor being attached to and in electrical contact with the anchor pad, and a contact strip stacked on the second piezoelectric transducer element, the contact strip electrically connecting second electrode of the second piezoelectric transducer element to the second conductor of the output lead.

21. An electro-mechanical pickup for providing two signal outputs from a musical instrument having a plurality of strings, comprising:

an elongated multi-faced core having a first face opposite a second face, a first piezoelectric transducer element connected in parallel with a second piezoelectric transducer element, each piezoelectric transducer element comprising:

a piezoelectric film having a first surface and a second surface, a first electrode on the first surface, the first electrode being divided into a first sub-electrode and a second sub-electrode, the first sub-electrode being electrically isolated from the second sub-electrode, and a second electrode on the second surface, the first piezoelectric transducer element being stacked on the core with the second electrode of the first piezoelectric transducer element in contact with the first face, and the second piezoelectric transducer element being stacked on the first piezoelectric transducer element with the first and second sub-electrodes of the second piezoelectric transducer element in contact with the first and second sub-electrodes, respectively, of the first piezoelectric transducer element, a first output lead attached to the core, the first output lead having a first conductor and a second conductor, the first conductor electrically contacting the first sub-electrode of the first piezoelectric transducer element and the first sub-electrode of the second piezoelectric transducer element, and the second conductor electrically contacting the second electrode of the first piezoelectric transducer element and the second electrode of the second piezoelectric transducer element, and a second output lead attached to the core, the second output lead having a first conductor and a second conductor, the first conductor electrically contacting the second sub-electrode of the first piezoelectric transducer element and the second sub-electrode of the second piezoelectric transducer element, and the second conductor electrically contacting the second electrode of the first piezoelectric transducer element and the second electrode of the second piezoelectric transducer element.

22. The pickup of claim 21 wherein the first face of the core is conducting and comprises a contact area, a first output lead connecting area and a second output lead connecting area, the first sub-electrode of the second piezoelectric transducer element is in electrical contact with the first output lead connecting area, the second sub-electrode of the second piezoelectric transducer element is in electrical contact with the second output lead connecting area, the second electrode of the first piezoelectric transducer element is in electrical contact with the contact area, and the first conductor of the first output lead is attached to and is in electrical contact with the first output lead connecting area the first conductor of the second output lead is attached to and is in electrical contact with the second output lead connecting area.

23. The pickup of claim 22 wherein the second face of the core is conducting and includes a first anchor pad and a second anchor pad, the second conductor of the first output lead is attached to and is in electrical contact with the first anchor pad, the second conductor of the second output lead is attached to and is in electrical contact with the second anchor pad, and the second face of the core is electrically connected to the contact area.

24. The pickup of claim 23 further comprising a contact strip stacked on the second piezoelectric transducer element, the contact strip electrically connecting the second electrode of the second piezoelectric transducer element to the second conductor of the first output lead and to the second conductor of the second output lead.

25. The pickup of claim 22 further comprising a contact strip stacked on the second piezoelectric transducer element, the contact strip electrically connecting the second electrode of the second piezoelectric transducer element to the second conductor of the first output lead and to the second conductor of the second output lead.

26. The pickup of claim 21 wherein the second face of the core is conducting and includes a first anchor pad and a second anchor pad, the second conductor of the first output lead is attached to and is in electrical contact with the first anchor pad, the second conductor of the second output lead is attached to and is in electrical contact with the second anchor pad, and the second face of the core is electrically connected to the contact area.

27. The pickup of claim 26 further comprising a contact strip stacked on the second piezoelectric transducer element, the contact strip electrically connecting the second electrode of the second piezoelectric transducer element to the second conductor of the first output lead and to the second conductor of the second output lead.

28. The pickup of claim 21 further comprising a contact strip stacked on the second piezoelectric transducer element, the contact strip electrically connecting the second electrode of the second piezoelectric transducer element to the second conductor of the first output lead and to the second conductor of the second output lead.

29. The pickup of claims 21, 22, 26, or 28 wherein, in each piezoelectric transducer element, the second electrode covers substantially all of the second surface of the piezoelectric film, and the periphery of the first electrode is inset from the periphery of the piezoelectric film.

* * * * *